US011707145B2

(12) United States Patent
Johnson

(10) Patent No.: US 11,707,145 B2
(45) Date of Patent: Jul. 25, 2023

(54) WIG MAINTENANCE AND STORAGE SYSTEM

(71) Applicant: Cynthia Johnson, Brookville, OH (US)

(72) Inventor: Cynthia Johnson, Brookville, OH (US)

( * ) Notice: Subject to any disclaimer, the term of this patent is extended or adjusted under 35 U.S.C. 154(b) by 0 days.

(21) Appl. No.: 17/746,026

(22) Filed: May 17, 2022

(65) Prior Publication Data

US 2022/0378228 A1 Dec. 1, 2022

Related U.S. Application Data

(60) Provisional application No. 63/335,264, filed on Apr. 27, 2022, provisional application No. 63/193,642, filed on May 27, 2021.

(51) Int. Cl.
*A47F 7/06* (2006.01)
*A47K 3/28* (2006.01)

(52) U.S. Cl.
CPC ..... *A47F 7/065* (2013.01); *A47K 3/281* (2013.01)

(58) Field of Classification Search
CPC ..... A47F 7/06; A47F 7/065; A47K 3/281; A45D 44/04
See application file for complete search history.

(56) References Cited

U.S. PATENT DOCUMENTS 503,949 A * 8/1893 Crouch ..... A47G 25/10 211/32
563,605 A * 7/1896 Marshall ..... A47G 25/10 211/30
D29,729 S * 11/1898 Brough ..... 211/32
621,023 A * 3/1899 Boas ..... A47F 7/06 211/32
639,050 A * 12/1899 Hurdel ..... A45C 11/02 312/351
781,369 A * 1/1905 Scott ..... A47G 25/10 211/31
807,904 A * 12/1905 Billings ..... A47F 7/06 211/32
821,364 A * 5/1906 Jessel ..... A47G 25/0685 211/32
1,091,812 A * 3/1914 Corthell ..... A47F 7/06 211/32
1,171,198 A * 2/1916 Hellberg ..... E04F 10/0614 211/32

(Continued)

FOREIGN PATENT DOCUMENTS

KR 101764243 B1 8/2017

*Primary Examiner* — Stanton L Krycinski
(74) *Attorney, Agent, or Firm* — Argus Intellectual Enterprise; Jordan Sworen; Daniel Enea

(57) ABSTRACT

A wig maintenance and storage system is provided. The wig maintenance and storage system includes one or more wig pods that are mountable to one or more panels, such as a door panel, a travel panel, and a shower rack panel. The wig pod is universal to each panel and is able to receive a wig thereon for washing, drying, storage and display. In one embodiment, each wig pod includes a front facing dome member extending from a base. The wig pods are reconfigurable on the door panel, travel panel, and/or shower rack panel via magnetic fasteners. In this way, the wearer can arrange the wigs and corresponding wig pods as desired. In some embodiments, the wig maintenance and storage system can be folded or disassembled for transport.

17 Claims, 8 Drawing Sheets

(56) References Cited

U.S. PATENT DOCUMENTS 1,380,747 A * 6/1921 Stanford ..... A47G 29/10 211/1
1,919,562 A * 7/1933 Kranzfelder ..... A45C 11/02 206/8
1,984,827 A * 12/1934 Derman ..... A47B 96/16 211/1
2,010,093 A * 8/1935 Lazarus ..... A47G 25/10 33/8
2,270,796 A * 1/1942 Hauser ..... A47G 25/08 211/35
D137,325 S * 2/1944 Portis ..... D6/682.6
2,416,464 A * 2/1947 Amen ..... A47G 25/10 211/100
2,630,921 A * 3/1953 Stephenson ..... A47G 25/10 211/32
2,954,874 A * 10/1960 Rouse ..... A47G 29/10 248/220.31
3,204,776 A * 9/1965 Brown ..... B25H 3/04 248/222.41
3,258,237 A * 6/1966 Beiman ..... A47K 5/05 108/42
3,438,480 A * 4/1969 Chabrelot ..... A45C 7/0045 206/8
3,506,112 A * 4/1970 Feinberg ..... A45C 11/00 312/351
3,515,318 A * 6/1970 Preble ..... A45D 44/14 223/66
3,602,372 A * 8/1971 Verrecchio ..... A47F 5/0853 211/100
3,603,322 A * 9/1971 Wilson ..... A45C 11/00 206/8
3,621,988 A * 11/1971 Songer ..... A45C 11/00 206/757
3,728,003 A * 4/1973 Bohannon ..... A47F 7/065 312/285
3,740,013 A 6/1973 Bentley et al.
3,779,433 A * 12/1973 Imai ..... A45D 44/14 223/66
3,820,694 A * 6/1974 Pabis ..... A47F 7/065 248/200.1
3,828,588 A * 8/1974 Duncan ..... A45D 44/14 34/103
4,324,446 A * 4/1982 LeSage ..... A45C 11/16 312/246
4,420,084 A * 12/1983 Whelan ..... A47F 7/02 211/85.2
4,805,782 A * 2/1989 Hale ..... A47G 25/10 34/103
4,848,585 A * 7/1989 Snyder ..... A45C 11/16 D6/567
4,978,001 A * 12/1990 Nelson ..... A47B 46/00 248/222.52
5,639,138 A * 6/1997 Smith ..... G09F 17/00 211/DIG. 1
5,671,849 A * 9/1997 Bacon ..... A47G 1/12 211/85.2
5,921,407 A * 7/1999 Kabanek ..... A61B 50/20 211/85.13
5,957,308 A * 9/1999 Zierenberg ..... A47B 81/005 211/119.004
6,085,916 A * 7/2000 Kovacevic ..... A47F 5/0815 211/87.01
6,112,909 A * 9/2000 Moseley ..... A47G 25/10 403/322.2
6,237,782 B1 * 5/2001 Hunn ..... A47F 7/163 211/47
6,273,274 B1 * 8/2001 Lyles ..... A47F 7/06 211/32
6,349,862 B1 2/2002 Smith et al.
6,591,995 B1 * 7/2003 Grove ..... A47F 5/0815 211/87.01
6,991,118 B2 * 1/2006 Phillips ..... A47B 81/00 211/49.1
7,168,577 B1 * 1/2007 Moseley ..... A47F 7/06 211/32
7,374,052 B2 * 5/2008 Price ..... A47F 5/0006 211/DIG. 1
7,389,868 B2 * 6/2008 Lewand ..... A47G 1/12 211/85.2
7,481,340 B2 * 1/2009 Murphy ..... A47G 25/743 211/85.3
D601,798 S * 10/2009 Hsu ..... D3/903
7,828,254 B2 * 11/2010 Stephens-De Alanis ..... A45D 44/00 248/309.4
7,984,567 B2 * 7/2011 Bertakis ..... A45D 44/14 34/100
D647,710 S * 11/2011 Anderson ..... A47F 7/19 D6/327
8,292,094 B2 * 10/2012 Morton ..... A47B 81/00 211/64
8,439,210 B1 * 5/2013 Griffith ..... A47G 25/10 211/32
D702,964 S 4/2014 Sterling
8,727,110 B2 * 5/2014 Walsh ..... A47G 29/08 206/6.1
8,851,089 B1 * 10/2014 Rogers ..... A45C 11/26 132/312
8,950,591 B1 * 2/2015 McDowell ..... A45D 44/14 211/13.1
9,226,606 B1 * 1/2016 Nesladek ..... A47G 25/10
9,250,029 B1 * 2/2016 Moore ..... A47K 10/06
9,332,820 B2 * 5/2016 Bernard ..... A45D 44/02
9,538,831 B1 * 1/2017 Tracy ..... D06F 57/04
10,010,157 B2 * 7/2018 Drain ..... A45D 44/14
10,111,546 B1 * 10/2018 Springs ..... A47G 29/08
10,172,484 B2 * 1/2019 Maldonado ..... A47F 7/06
10,568,421 B2 * 2/2020 Felsenthal ..... A47G 29/087
10,898,013 B2 * 1/2021 Kempner ..... A45C 11/16
11,147,404 B1 * 10/2021 Duffy ..... A47B 43/003
11,259,655 B1 * 3/2022 Humphries ..... A45D 44/14
11,478,054 B2 * 10/2022 Nolan Krouse ..... A45C 13/103
2003/0234185 A1 * 12/2003 Flagg ..... A45C 11/16 211/85.2
2004/0222125 A1 * 11/2004 Meing ..... A45C 11/26 206/581
2005/0098510 A1 * 5/2005 Lom ..... A47F 7/147 211/13.1
2007/0039903 A1 2/2007 Aiken
2007/0119804 A1 * 5/2007 Antonioni ..... A47F 5/0807 211/86.01
2007/0241071 A1 * 10/2007 Antonioni ..... A47F 5/0807 211/87.01
2009/0194650 A1 * 8/2009 Corvo ..... A47G 1/02 248/205.3
2010/0276382 A1 * 11/2010 Antonioni ..... A47F 5/0807 211/59.2
2014/0263116 A1 * 9/2014 Wojciechowski ..... A47F 5/0807 211/85.2
2014/0319083 A1 * 10/2014 Stark ..... A47K 3/281 211/26
2015/0129455 A1 * 5/2015 Williams ..... A45D 44/00 206/526
2016/0262560 A1 * 9/2016 Fields ..... A47G 25/10
2017/0188732 A1 7/2017 Wood
2020/0015606 A1 1/2020 Ji
2022/0167761 A1 * 6/2022 Lipsey ..... A41G 3/0041

* cited by examiner

WIG MAINTENANCE AND STORAGE SYSTEM

CROSS REFERENCE TO RELATED APPLICATION

This application claims the benefit of U.S. provisional application No. 63/193,642 filed on May 27, 2021, and U.S. provisional application No. 63/335,264 filed on Apr. 27, 2022. The above identified patent applications are herein incorporated by reference in their entirety.

BACKGROUND OF THE INVENTION

The present invention relates to a wig maintenance and storage system. The present invention specifically provides a wig maintenance and storage system for cleaning and drying a wig from a shower head and storing and displaying a plurality of wigs in any desired arrangement on a panel, where the panel may be positioned on a wall or the back of a door.

It is generally known that many wigs and various other forms of hairpieces are manufactured from human hair or synthetic fibers. It is also common that wearers have many styles or replacement wigs that are used for different occasions. These wigs require periodic conditioning such as washing, drying, and styling.

Wig hair stylists and their clients have always had the problem of conveniently cleaning and drying wigs and transporting and storing styled wigs. Therefore, it is desirable to clean and store wigs when not required for use in a way which preserves their shape and does not take up more space than necessary. It is likewise desirable to be able to transport and store these wigs to varied locations in the same manner. There are a variety of stands in the marketplace for wig storage, but while a stand may be satisfactory to maintain the wig shape, the wig stands are stored in a manner that occupies a large space. For example, one such stand utilizes a mannequin head on a base that sets on a counter. Other wig stands allow only for stationary vertical or linear storage of wigs on a rack that takes up significant floor space, space on clothes racks or wall space and that are screwed into wall studs and are not easy to assemble or disassemble. These manners of storage also cause adjacent wig entanglement providing for no adjustment for wig lengths. These devices are too voluminous and do not display multiple wigs in a pleasing manner. Furthermore, wigs are typically washed by hand in a sink or shower and dried by mechanical means such as with dryers which can alter the wig's appearance or drip dried over obstacles such as hangers that do not maintain the wig's shape. Carrying wet wigs from sinks to showers can also create wet slippery floors.

Additionally, wigs need to be transported and stored with the wearer at varied locations. Usually, transport devices are voluminous such as wig heads, floor or wall stands that may take up voluminous space in luggage and when storing at varied locations can require extensive reassembly. Therefore, there exists a need for a wig maintenance and storage system that requires no disassembly, takes up little storage space in luggage for transport to varied locations and can be used to store wigs at the varied location in the same manner with ease.

In light of the devices disclosed in the known art, it is submitted that the present invention substantially diverges in design elements and methods from the known art and consequently it is clear that there is a need in the art for an improvement of a modular wig rack storage system. In this regard the instant invention substantially fulfills these needs.

SUMMARY OF THE INVENTION

In view of the foregoing disadvantages inherent in the known types of wig maintenance and storage systems now present in the known art, the present invention provides a wig maintenance and storage system wherein the same can be utilized for washing, drying, storing and displaying a plurality of wigs from various panels and transported conveniently from the same storage to different locations.

It is an objective of the present invention to provide a wig maintenance and storage system comprising one or more wig pods mountable to one or more panels, wherein each wig pod is adapted to receive a wig thereon for maintenance, storage and display, wherein the one or more panels are selected from the group consisting of a door panel, a travel panel, and a shower rack panel.

It is another objective of the present invention to provide a wig maintenance and storage system wherein each wig pods comprises a front facing semi-spherical wig holder extending from a base.

It is yet another objective of the present invention to provide a wig maintenance and storage system that is modular such that the user can selectively rearrange the wig pods in a desired configuration.

It is also an objective of the present invention to provide a wig maintenance and storage system that is reconfigurable with various surfaces, such that the embodiments are functional with doors and protruding members, such as wall hooks, showerheads, and the like.

It is therefore an object of the present invention to provide a new and improved wig maintenance and storage system that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for cleaning, drying, storing and displaying wigs mounted to the butterfly pods of the wig maintenance and storage system. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

Figure 1:
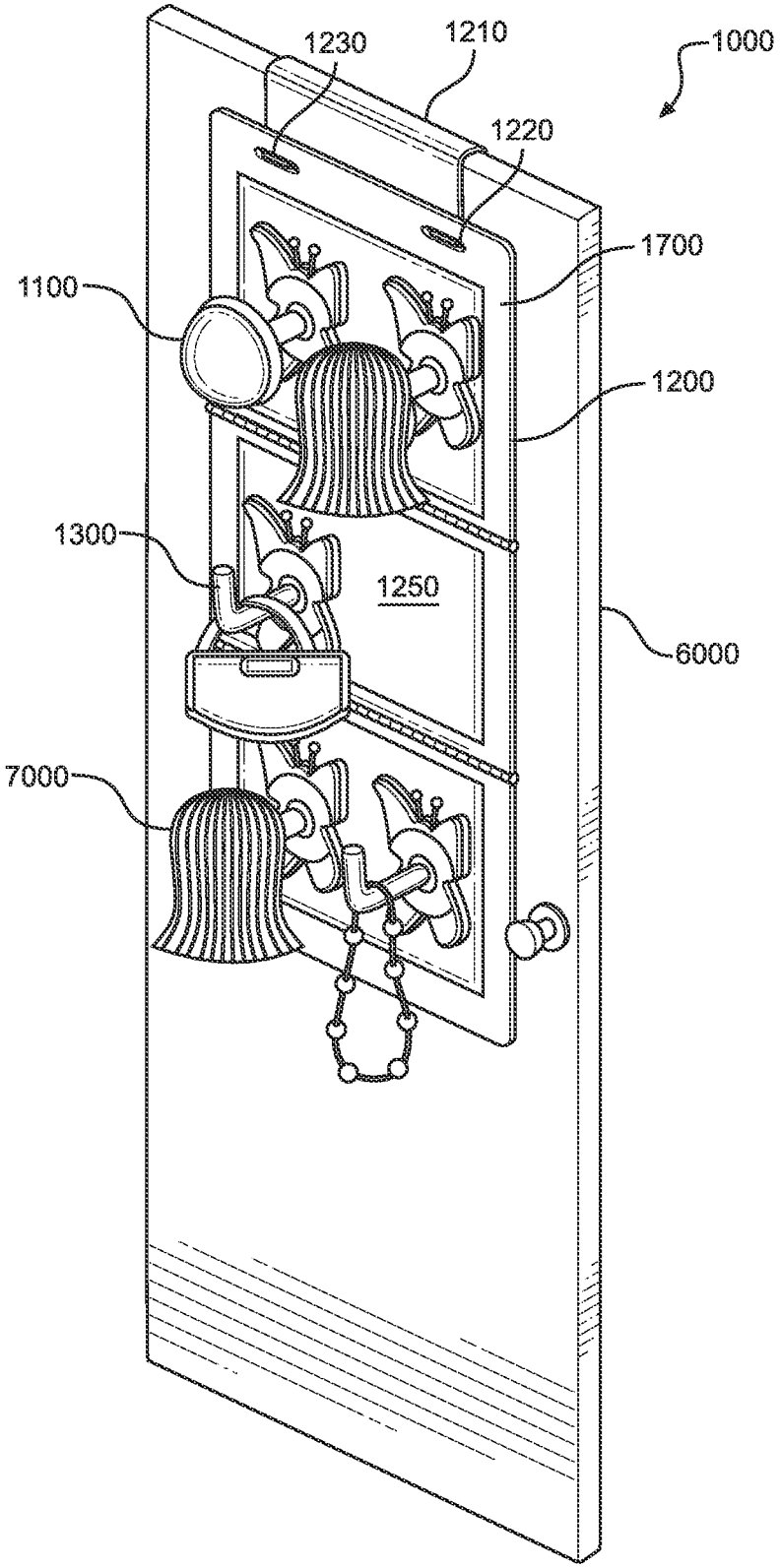
FIG. 1 shows a perspective view of an embodiment of the wig maintenance and storage system in use.
Figure 2:
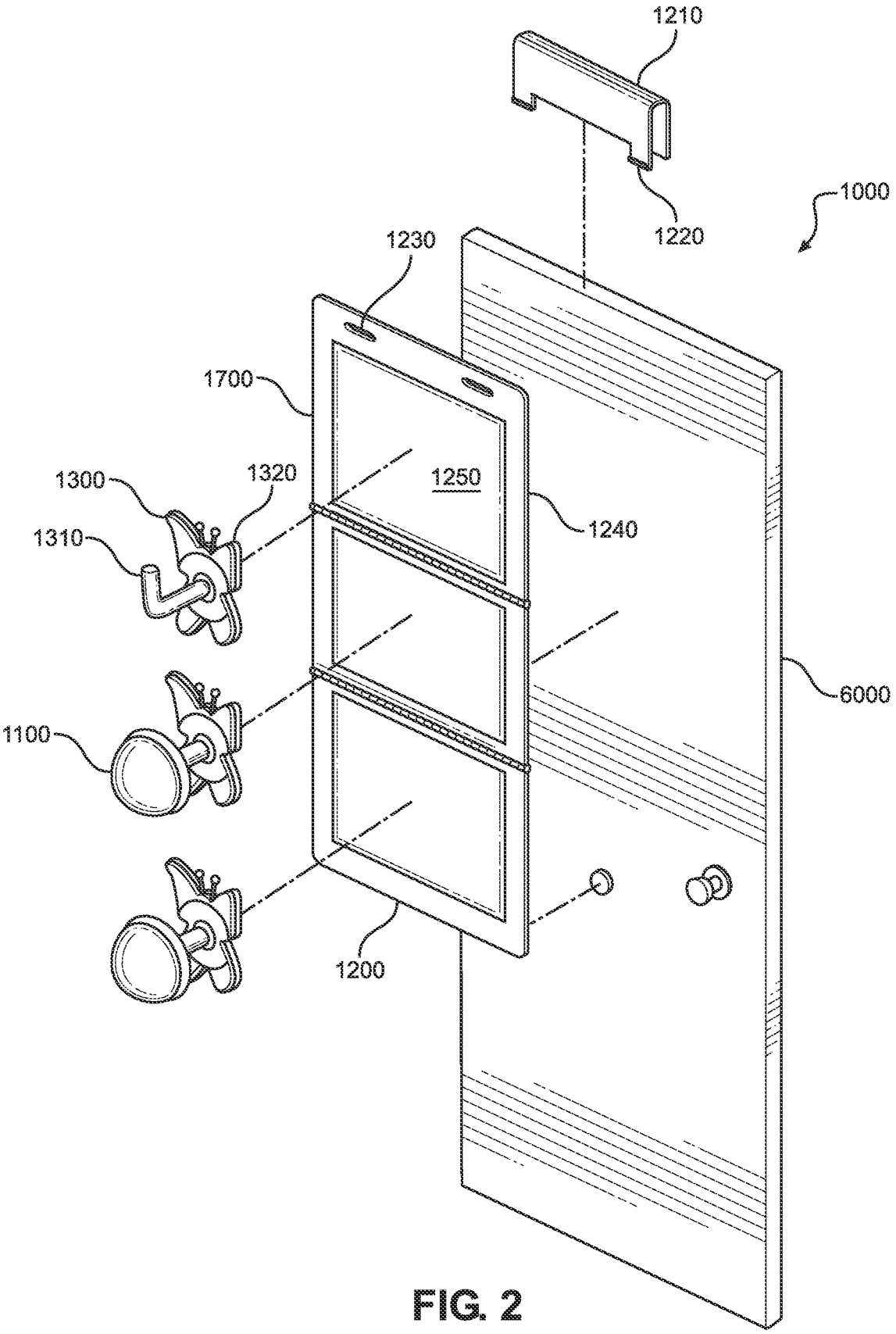
FIG. 2 shows an exploded view of an embodiment of the wig maintenance and storage system.

Referring now to FIGS. 1 and 2, there is shown a perspective view of an embodiment of the wig maintenance and storage system in use and an exploded view of an embodiment of the wig maintenance and storage system, respectively. The wig maintenance and storage system 1000 provides a modular system that enables a user to store, dry, and display multiple wigs 7000 from various surfaces. For example, the wig maintenance and storage system 1000 can be used with a door 6000, a wall, a shower head, and the like. The wig maintenance and storage system 1000 comprises one or more wig pods 1100 mountable to one or more panels, wherein each wig pod 1100 is adapted to receive a wig 7000 thereon such that the wig 7000 remains neatly arranged until it is ready to be donned by a user.

The system 1000 comprises at least one mountable panel 1700 that is adapted to secure to or suspend from a support surface. In the shown embodiment, the one or more panels 1700 are selected from the group consisting of a door panel 1200, a travel panel, and a shower rack panel. The door panel 1200 is configured to receive a plurality of wig pods 1100, the travel panel is adapted to receive at least one wig pod 1100, and the shower rack panel is configured to suspend from a shower head to allow a wig 7000 to be easily washed and dried in the shower. The wig pod 1100 is universal to each panel 1700, allowing the panels to be used interchangeably when washing, drying, storing, or displaying the wig. In alternate embodiments, the system 1000 comprises additional panels other than the door panel 1200, the travel panel, and the shower rack panel. In some embodiments, the system 1000 comprises a single panel and, in other embodiments, the system comprises two or more panels.

In the shown embodiment, the panel 1700 is a door panel 1200 configured to mount over an upper end of a door 6000. The door panel 1200 comprises a flat surface 1205 configured to receive a plurality of wig pods 1100 thereon. The door panel 1200 comprises a removable over the door u-shaped bracket 1210 that is adapted to suspend the door panel 1200 along a side of the door 6000. The bracket 1210 comprises a pair of protrusions 1220 that align with a pair of apertures 1230 extending along an upper end 1240 of the door panel 1200. In other embodiments, the bracket 1210 is securable to the door panel 1200 via any suitable fastening means. In alternate embodiments, the bracket 1210 is permanently affixed to the door panel 1200. The width of the bracket 1210 is smaller than the width of the door panel 1200. In the illustrated embodiment, the door panel 1200 comprises a rectangular cross section that corresponds with a general shape of a convention rectangular door. However, in alternate embodiments, the door panel 1200 is any suitable shape configured to lay within the boundaries of a door to which it can attach thereto.

In the illustrated embodiment, each panel 1700 comprises a flat surface configured to magnetically receive each wig pod 1100. In other embodiments, the panels and wig pods are secured to one another via any suitable fastener, such as male and female interlocking fasteners. However, the magnetic fastener allows the wig pods 1100 to be arranged in any suitable manner on the panel 1700, allowing adequate or a desired distance between each wig pod 1100. For example, some wigs 7000 are longer than other wigs and require additional distance between a second adjacent wig to prevent tangling or contact between the wigs. In one embodiment, the door panel 1200 is sized to support at least five wig pods 1100 simultaneously thereon. Each wig pod 1100 is magnetically and selectively positionable on the front surface 1205 of the door panel 1200 and may be moved as desired by the user. In the illustrated embodiment, the wig pods 1100 can be secured to the door panel 1200 in a staggered formation to allow for more compact storage without adjacent wigs becoming entangled.

Figure 3:
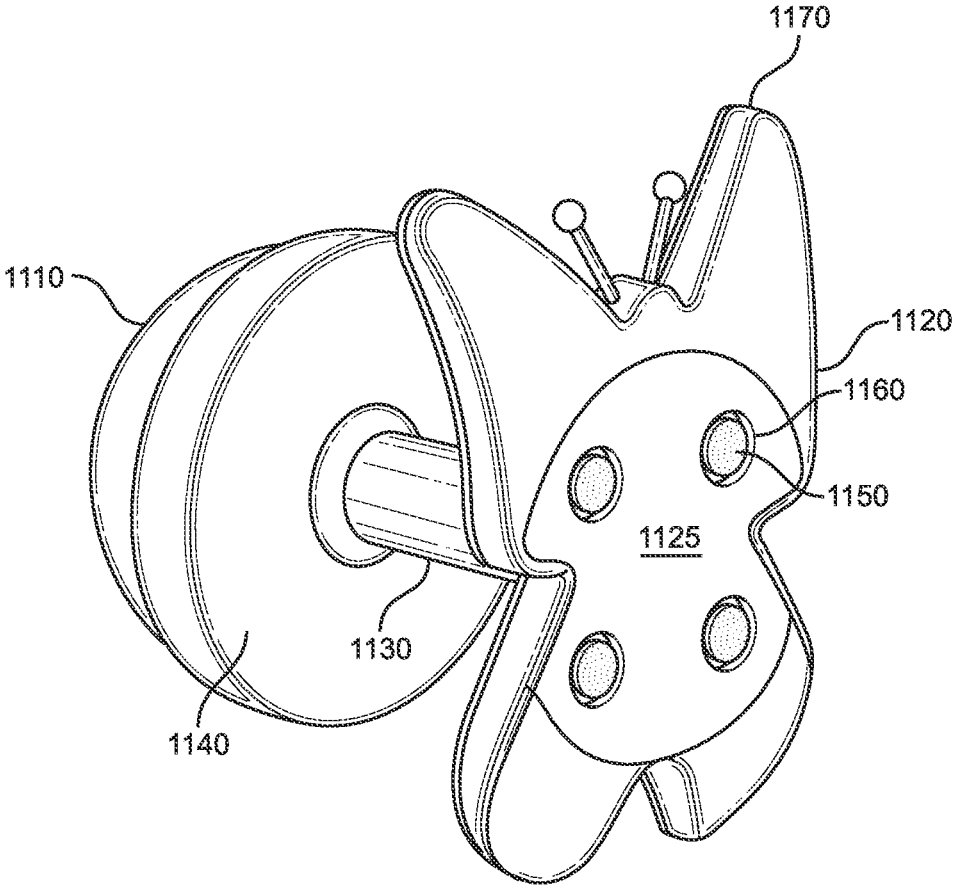
FIG. 3 shows a perspective view of a rear side of a wig pod of the wig maintenance and storage system.

Referring now to FIG. 3, there is shown a perspective view of a rear side of a wig pod of the wig maintenance and storage system. In the illustrated embodiment, the wig pod 1100 comprises a front-facing dome member 1110 extending from a base 1120, wherein the dome member 1110 is adapted to receive a wig thereon for storage and display. The structure of the dome member 1110 mimics a general round shape of a head to allow the integrity and shape of the wig to be maintained while not being worn. The dome member 1110 includes a generally curved front facing portion and an opposing flat side 1140 that is rear facing. In the illustrated embodiment, the dome member comprises a substantially similar size to the base. An arm 1130 extends from the flat side 1140 and connects with the base 1120 at a central region.

The base 1120 comprises a substantially planar surface 1125 to allow the wig pod 1100 to mount flush against a panel. In the illustrated embodiment, the base 1120 includes at least one magnetic fastener 1150 to allow the base 1120 to be removably positioned on any of the panels. In the illustrated embodiment, four magnetic fasteners 1150 are disposed within recesses 1160 of the rear side of the base 1120 such that the base remains flat when mounted to a panel. In other embodiments, the base 1120 includes any suitable number of magnetic fasteners.

In the illustrated embodiment, the base 1120 comprises a butterfly shape. However, in alternate embodiments, the base 1120 comprises any suitable shape. The butterfly shape provides raised corners 1170 that allow a user to easily slide his or her fingers behind the base 1120 to grasp and remove the wig pod 1100 from each panel.

In some embodiments, the wig maintenance and storage system comprises a second wig pod (shown in FIG. 1, 1300) comprising a hook member 1310 extending from a base 1320, wherein the base is magnetically securable to a panel. The second wig pod is adapted to receive jewelry, purses, clothing, and other accessories thereon.

Figure 4:
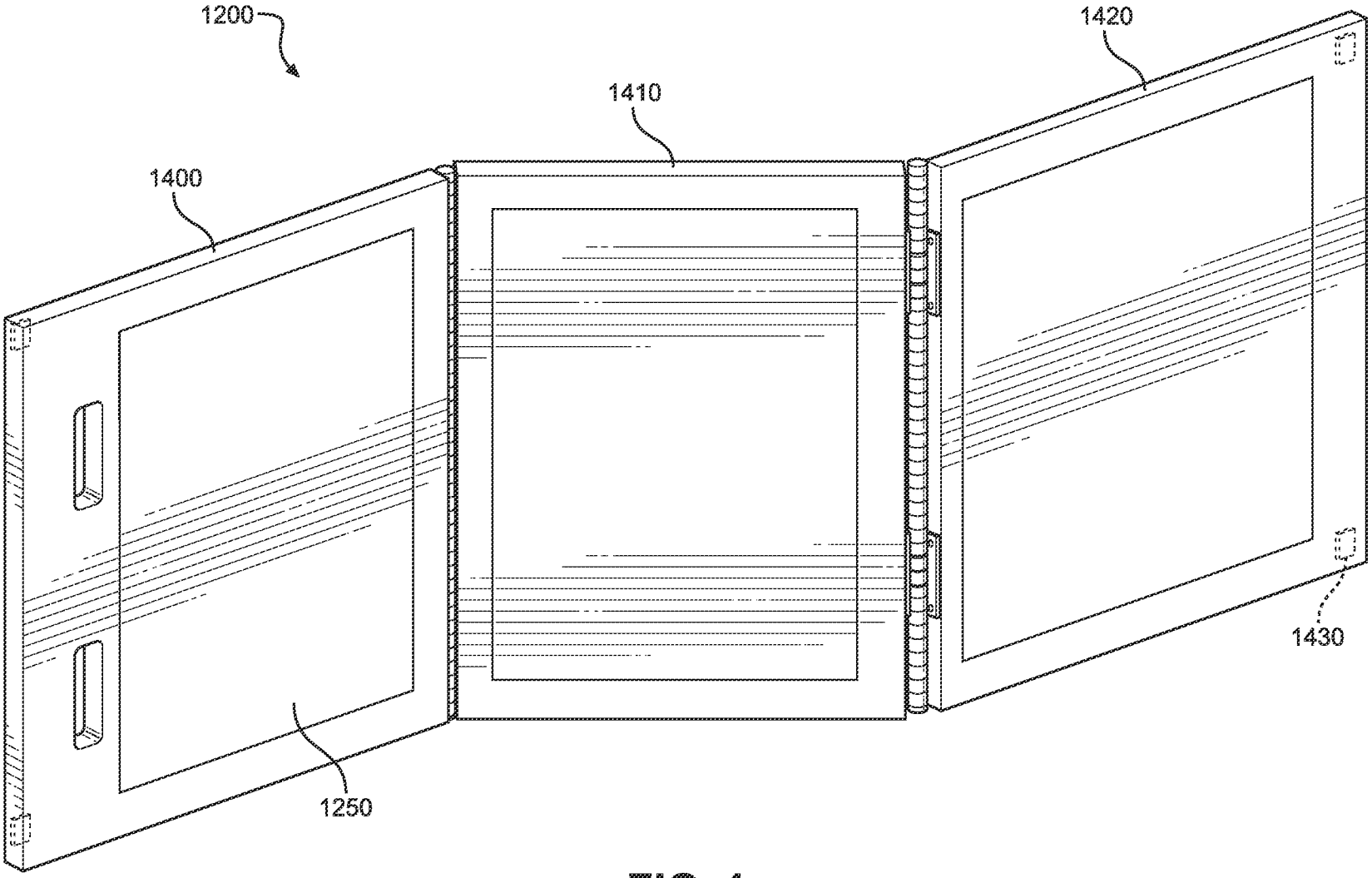
FIG. 4 shows a perspective view of a door panel of an embodiment of the wig maintenance and storage system.
Figure 5:
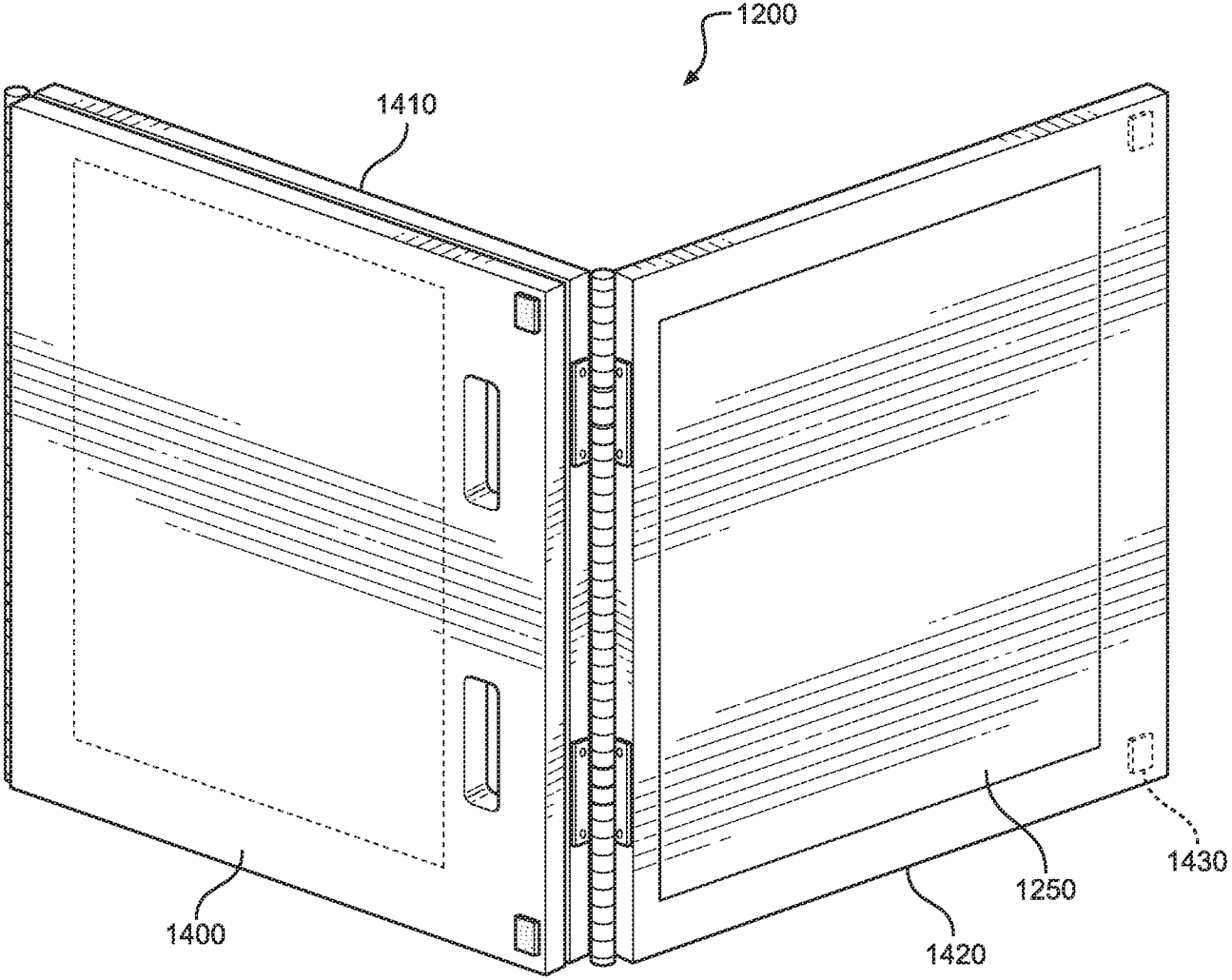
FIG. 5 shows a perspective view of a door panel of an embodiment of the wig maintenance and storage system, wherein the door panel is in a partially folded configuration.
Figure 6:
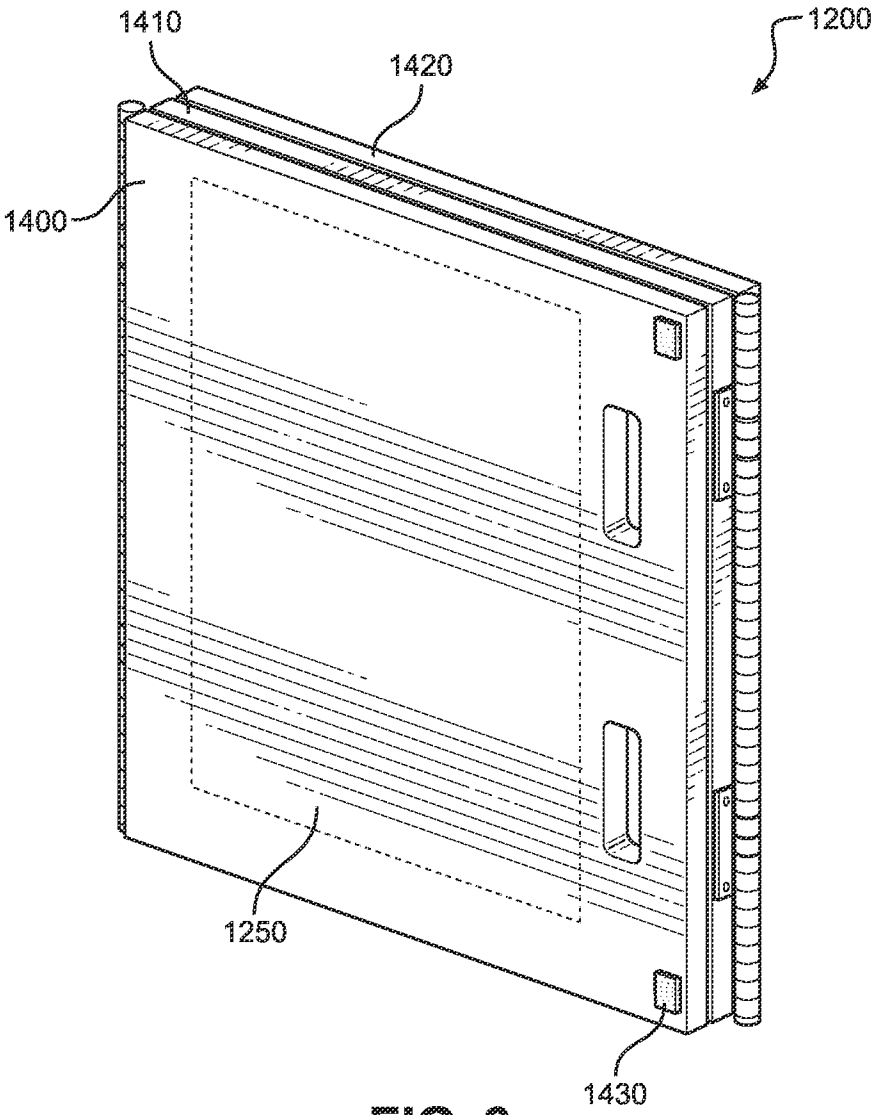
FIG. 6 shows a perspective view of a door panel of an embodiment of the wig maintenance and storage system, wherein the door panel is in a folded configuration.

Referring now to FIGS. 4-6, there is shown a perspective view of a door panel of an embodiment of the wig maintenance and storage system, a perspective view of a door panel of an embodiment of the wig maintenance and storage system, wherein the door panel is in a partially folded configuration, and a perspective view of a door panel of an embodiment of the wig maintenance and storage system, wherein the door panel is in a folded configuration, respectively. In the illustrated embodiment, the door panel 1200 is foldable for convenient and easy transport and storage thereof. The door panel comprises a first, a second, and a third section 1400, 1410, 1420 disposed in a side-by-side arrangement. The first and third sections are configured to fold on to opposite sides of the second section such that the sections are disposed in a stacked position when completely folded. In the illustrated embodiment, each section comprises a same length and width to one another. In alternate embodiments, the sections comprise different dimensions from one another.

Each section comprises a magnetic receiving plate 1250 adapted to receive a plurality of wig pods thereon. The magnetic receiving plate 1250 comprises any material suitable to receive and secure a magnet thereto. In the illustrated embodiment, the magnetic receiving plate 1250 substantially covers each section. In some embodiments the plate 1250 covers each section entirely. In some embodiments, the entire sections are magnetic such that the plate is not required. In other embodiments, only a first and/or second section include a magnetic receiving plate. In alternate embodiments, the door panel the door panel is configured to be disassembled for transport and storage purposes % in some embodiments, the storage rack is separable into at least two pieces. In some embodiments, the door panel is a monolithic structure. In the illustrated embodiment, each section is approximately 14 inches in length by 20 inches in width. In the illustrated embodiment, the remaining frame of the door panel 1200 is composed of a lightweight material, such as plastic.

In the illustrated embodiment, each corner of the door panel 1200 comprises a stopper 1430 that prevents the panel from directly contacting the door. The stopper is composed of rubber or other suitable material configured to prevent scratching or sliding of the door panel 1200.

Figure 7:
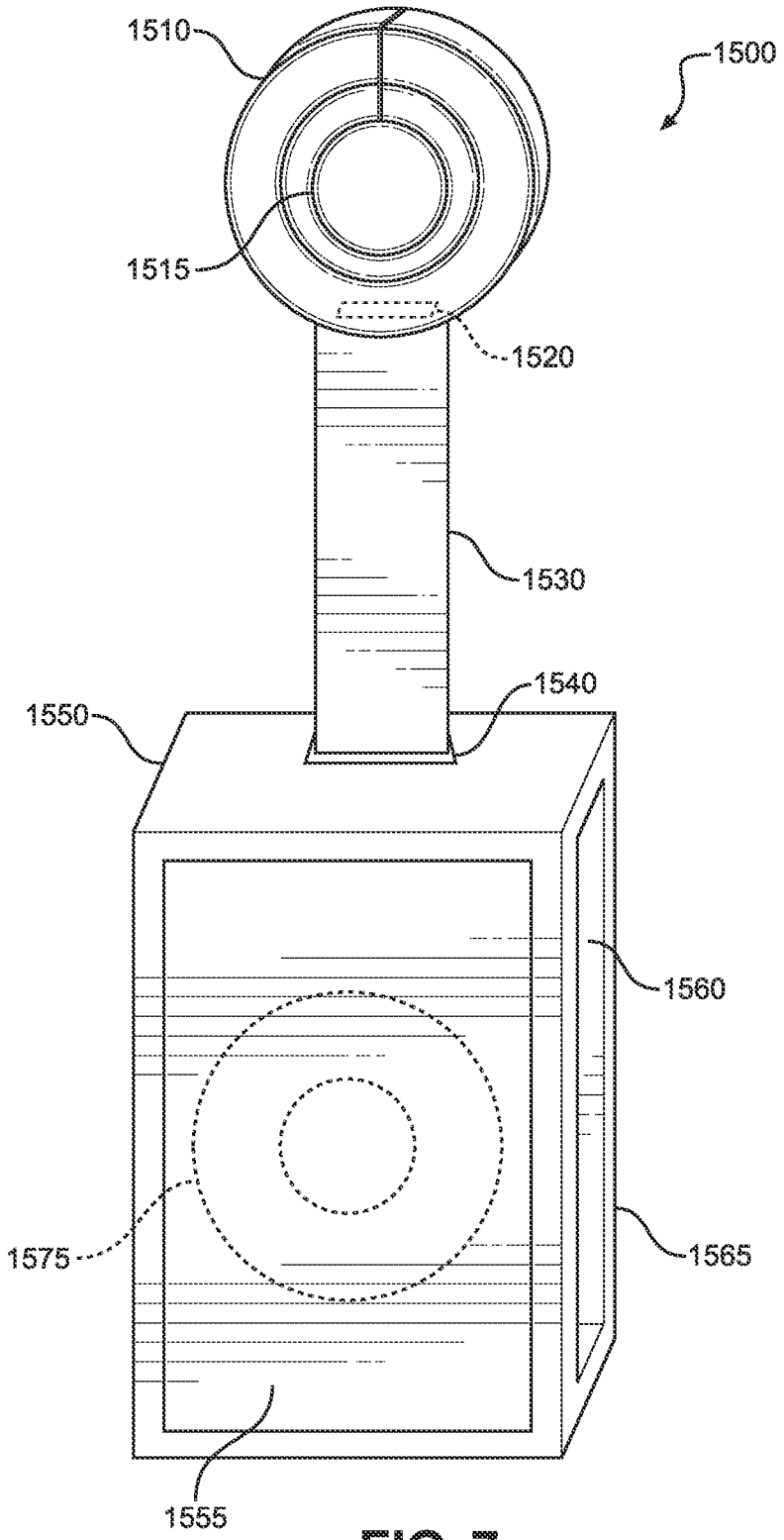
FIG. 7 shows a perspective view of a shower rack panel of an embodiment of the wig maintenance and storage system.

Referring now to FIG. 7, there is shown a perspective view of a shower rack panel of an embodiment of the wig maintenance and storage system. In the shown embodiment, the wig maintenance and storage system comprises a shower rack panel 1500 for suspending a wig pod from a showerhead. The shower rack panel 1500 comprises a fastener for mounting to the showerhead or other protruding member, such as a hook. In the illustrated embodiment, the fastener is a ring member 1510 capable of opening and closing via a clip fastener or the like. In some embodiments, the clip fastener comprises a male and female interlocking fastener. In other embodiments, the clip fastener is a magnetic fastener or a hook. In some embodiments, the ring member does not open and instead is configured to slide on and off of the showerhead. In the shown embodiment, a rubber insert 1515 or gasket is disposed on an interior perimeter of the ring member 1500 to prevent the ring member 1500 from sliding along the showerhead. The ring member 1500 comprises a strap aperture 1520 for receiving a strap 1530 therethrough. The strap 1530 is securable to and configured to extend through an aperture 1540 of a drying pod bracket 1550. In some embodiments, a plate is disposed to the end of the strap 1530 to prevent the strap from being removed from the aperture of the drying pod bracket 1550. In the illustrated embodiment, a channel 1560 extends through the drying pod bracket 1550 such that the bracket 1560 only comprises a front side 1555 and a rear side 1565.

In the illustrated embodiment, the front side 1555 of the pod bracket 1550 is sized to support the wig pod such that the wig pod is disposed within the bounds of the front side 1555 when secured to the pod bracket 1550. In some embodiments, the rear side of the pod bracket 1550 comprises a suction cup 1575 configured to secure the pod bracket 1550 to a surface. The suction cup 1575 prevents the shower rack panel from lateral movement when secured to a shower head.

In the illustrated embodiment, one of the panels of the wig maintenance and storage system is the shower rack panel 1500. The shower rack panel 1500 is configured to receive a single wig pod for washing and drying a wig while in the shower. In some embodiments, the shower rack panel is configured to receive multiple pods.

Figure 8:
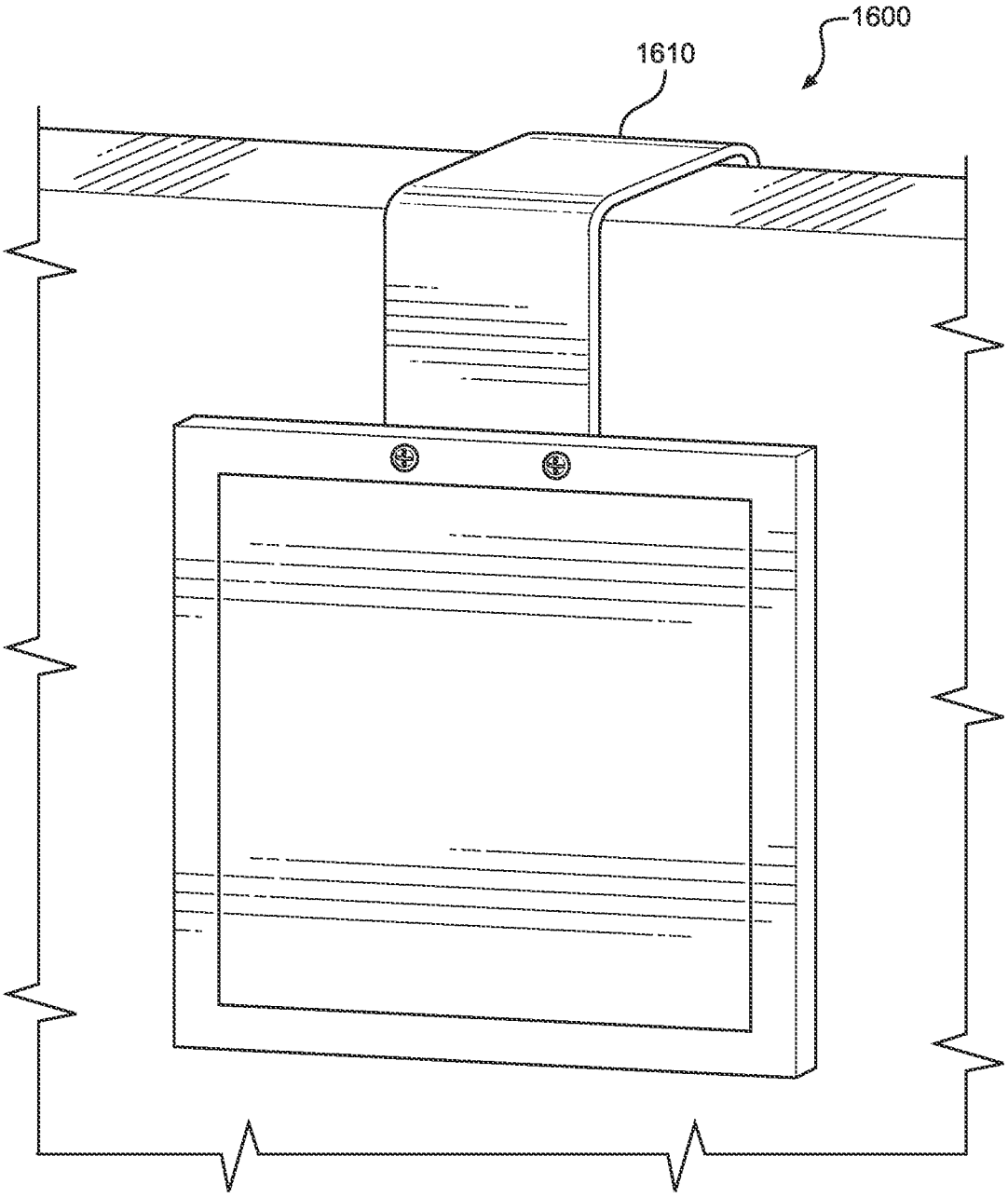
FIG. 8 shows a perspective view of a travel panel of an embodiment of the wig maintenance and storage system.

Referring now to FIG. 8, there is shown a perspective view of a travel panel of an embodiment of the wig maintenance and storage system. In the illustrated embodiment, the wig pod is adapted to mount directly to a travel panel 1600. The travel panel 1600 includes a generally flat surface that is magnetic and adapted to removably receive one or more wig pods. The travel panel 1600 is smaller than the door panel and configured to be mounted to a wall or other surface via fasteners. In some embodiments, the travel panel 1600 comprises a substantially square cross section and measures a length of 12 inches by a width of 12 inches, such that the panel 1600 can be easily transported in a suitcase. In the illustrated embodiment, the travel panel 1600 comprises a magnetic plate mounted to a frame. In the shown embodiment, the travel panel 1600 is mountable over a door via a U-shaped door bracket 1610.

In the illustrated embodiment, the travel panel 1600 is configured to be selectively mounted to a wall or over a door by interchanging the type of mounting fastener. In some embodiments, the U-shaped bracket is removable via unfastening of the screws. In other embodiments, the U-shaped door bracket is removably fastened to the travel panel similarly to the protrusion and aperture fastener arrangement as seen in FIGS. 1 and 2 of the door panel. Once the U-shaped bracket 1610 is separated from the travel panel 1600, an adhesive fastener is used to adhere the travel panel to the wall. In some embodiments, the travel panel is mountable to a wall via a pair of double-sided adhesive strips that are securable to a rear side of the travel panel. In other embodiments, any suitable fastener may be used to secure the travel panel to a surface. The double-sided adhesive strips allow the travel panel to be easily removed from a wall and re-adhered to another location, as desired. The travel panel is adapted to be mounted on underutilized wall spaces, such as closets, corner spaces, and other available unused wall space. Furthermore, the travel panel 1600 is a smaller wig or accessory storage unit to permit travel and destination storage of a wig or accessories more convenient. The travel panel 1600 is dimensioned to occupy minimal space in a suitcase and can be easily hung on any door anywhere the user is traveling.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wig maintenance and storage system, comprising:

a wig pod mountable to one or more panels, wherein the one or more panels comprise a door panel, a travel panel, and a shower rack panel;

wherein the door panel is configured to mount to a side of a door;

wherein the wig pod comprises a front-facing dome member extending from a base, the dome member adapted to receive a wig thereon;

wherein a back-side of the base is removably securable to a front surface of the door panel, such that a plurality of wig pods are adapted to be secured to the door panel in a staggered configuration such that wig pods positioned on a first row are offset from the wig pods on a second row, wherein the first row and the second row extend along different lateral axes;

wherein the travel panel is configured to suspend from a side of a door, wherein the travel panel is sized to receive only a single wig pod thereon;

wherein the shower rack panel includes a ring member adapted to secure over a showerhead.

2. The wig maintenance and storage system of claim 1, wherein each wig pod comprises a non-slip adhesive strip positioned on a perimeter of the front facing dome member.

3. The wig maintenance and storage system of claim 1, wherein the base includes magnetic fasteners on a rear side, the magnetic fasteners adapted to removable secure to the one or more panels.

4. The wig maintenance and storage system of claim 1, wherein the door panel comprises a U-shaped bracket extending from an upper end of the door panel and configured to secure around an upper end of the door.

5. The wig maintenance and storage system of claim 4, wherein the U-shaped bracket comprises a pair of protrusions that align with a pair of apertures extending along an upper end of the door panel to permit the U-shaped bracket to be separated from the remaining door panel.

6. The wig maintenance and storage system of claim 1, wherein the dome member comprises a generally curved front facing portion and an opposing flat side that is rear facing, wherein an arm extends from the flat side and connects with the base at a central region.

7. The wig maintenance and storage system of claim 1, wherein the dome member comprises a substantially similar size to the base.

8. The wig maintenance and storage system of claim 1, wherein the wig pod is magnetically securable to the door panel to allow the wig pod to be positioned anywhere on a receiving surface of the door panel.

9. The wig maintenance and storage system of claim 8, wherein the receiving surface is any point on the door panel configured to magnetically receive the wig pod.

10. The wig maintenance and storage system of claim 1, further comprising a second wig pod having a hook member extending from a base, wherein the base is magnetically securable to the door panel.

11. The wig maintenance and storage system of claim 1, wherein the door panel is foldable into a first section, a second section, and a third section, such that in a folded configuration, all of the first, second, and third sections are disposed in a stacked configuration.

12. The wig maintenance and storage system of claim 11, wherein each of the first, second, and third sections comprise a same length and width to one another.

13. The wig maintenance and storage system of claim 1, wherein a corner of the base curves toward the front side of the wig pod to serve as a finger hold for a user when detaching the wig pod from the door panel.

14. The wig maintenance and storage system of claim 1, wherein the shower rack panel comprises a drying pod bracket suspended from the ring member by a flexible strap.

15. The wig maintenance and storage system of claim 14, wherein the drying pod bracket comprises a channel extending therethrough forming a front side and a rear side, void of sidewalls disposed between the front and rear sides.

16. A wig maintenance and storage system, comprising:

a wig pod mountable to one or more panels, wherein the one or more panels comprise a door panel, a shower rack panel, and a travel panel;

wherein the door panel comprises a plurality of foldable sections and configured to mount over an upper side of a door;

wherein the wig pod comprises a front-facing dome member extending from a base, the dome member adapted to receive a wig thereon;

wherein a back-side of the base is removably securable to a front surface of the door panel, such that a plurality of wig pods are adapted to be secured to the door panel in a staggered configuration such that wig pods positioned on a first row are offset from the wig pods on a second row, wherein the first row and the second row extend along different lateral axes;

wherein the shower rack panel comprises a ring member adapted to suspend from a surface and a drying pod bracket operably connected to the ring member;

wherein the travel panel is sized to receive only a single wig pod thereon.

17. A wig maintenance and storage system, comprising:

a wig pod mountable to one or more panels, wherein the one or more panels comprise a door panel and a shower rack panel;

wherein the door panel is configured to mount over an upper side of a door and comprises a plurality of foldable sections;

wherein the wig pod comprises a front-facing dome member extending from a base, the dome member adapted to receive a wig thereon;

wherein a back-side of the base is removably securable to a front surface of the door panel, such that a plurality of wig pods are adapted to be secured to the door panel in a staggered configuration such that wig pods positioned on a first row are offset from the wig pods on a second row, wherein the first row and the second row extend along different lateral axes;

wherein the shower rack panel comprises a ring member adapted to suspend from a surface and a drying pod bracket operably connected to the ring member.

* * * * *